US007591652B2

(12) United States Patent
Goto et al.

(10) Patent No.: US 7,591,652 B2
(45) Date of Patent: Sep. 22, 2009

(54) ELECTRICAL CONNECTOR AND METHOD OF PRODUCING THE SAME

(75) Inventors: Masayuki Goto, Tokyo (JP); Kazuhiko Ikeda, Tokyo (JP); Fumio Oshita, Toyama (JP)

(73) Assignees: Hirose Electric Co., Ltd., Tokyo (JP); Takamatsu Plating Co., Ltd., Toyama (JP)

( * ) Notice: Subject to any disclaimer, the term of this patent is extended or adjusted under 35 U.S.C. 154(b) by 0 days.

(21) Appl. No.: 11/892,457

(22) Filed: Aug. 23, 2007

(65) Prior Publication Data

US 2008/0057794 A1 Mar. 6, 2008

(30) Foreign Application Priority Data

Aug. 31, 2006 (JP) ..... 2006-235015

(51) Int. Cl.
*H01R 12/00* (2006.01)

(52) U.S. Cl. ..... 439/74

(58) Field of Classification Search ..... 439/74, 439/571, 572, 931

See application file for complete search history.

(56) References Cited

U.S. PATENT DOCUMENTS

| | | | | |
|---|---|---|---|---|
| 5,885,092 | A * | 3/1999 | Ito et al. | 439/74 |
| 5,904,581 | A * | 5/1999 | Pope et al. | 439/74 |
| 6,326,568 | B2 * | 12/2001 | Martucci et al. | 200/283 |
| 6,328,615 | B1 * | 12/2001 | Safai | 439/851 |
| 6,884,089 | B2 * | 4/2005 | Obikane et al. | 439/74 |
| 7,011,556 | B2 * | 3/2006 | Miyazawa et al. | 439/886 |
| 7,144,277 | B2 * | 12/2006 | Pan et al. | 439/660 |
| 2001/0014559 | A1 * | 8/2001 | Akimoto et al. | 439/736 |
| 2004/0102065 | A1 * | 5/2004 | Obikane et al. | 439/74 |
| 2005/0026466 | A1 * | 2/2005 | Kubo | 439/74 |

FOREIGN PATENT DOCUMENTS

| | | |
|---|---|---|
| JP | 09-259989 | 10/1997 |

* cited by examiner

*Primary Examiner*—T C Patel
*Assistant Examiner*—Vladimir Imas
(74) *Attorney, Agent, or Firm*—Kubotera & Associates, LLC

(57) ABSTRACT

An electrical connector comprises a housing and a terminal held by the housing. The terminal is provided with a first surface exposed form the housing and a second surface contacted with the housing. The first surface is plated, and the second surface is not plated.

5 Claims, 2 Drawing Sheets

ELECTRICAL CONNECTOR AND METHOD OF PRODUCING THE SAME

BACKGROUND OF THE INVENTION

The present invention relates to an electrical connector and a method of producing the same. More specifically, the present invention relates to an electrical connector having terminals integrally formed with and held by a housing.

In Patent Reference, an electrical connector having terminals integrally formed with and held by the housing is disclosed. When the electrical connector is produced, all surfaces of the terminals having a carrier that are integrally formed with the carrier are plated. Further, terminal portions and the housing are integrally formed, so that the terminals are held by the housing. Then, the electrical connector is obtained by separating the carrier.

Patent Reference: Japanese Patent Publication No. 9-259989

In the electrical connector disclosed in Patent Reference, all surfaces of the terminals having the carrier are plated before the terminal portions and the housing are integrally formed. At this time, at least all the surfaces of the terminal portions are plated. When the terminal portions are integrally formed with and held by the housing, the plated surfaces of the terminals contact with the housing.

When a resin to form the housing is contracted after the terminal portions are integrally formed with the housing, there may be a slight gap between the housing and the terminals. Further, when a size or a height of the connector is reduced, a contact between the terminals and the housing may become poor. Accordingly, a gap may be formed between the housing and the terminals.

When a gap is formed between the housing and the terminals, and when the electrical connector is mounted to a circuit board, a solder and a flux may reach the gap described above from connection portions with respect to the circuit board of the terminals due to a surface tension. That is, the flux may rise when soldered. In the electrical connector disclosed in Patent Reference, the flux is likely to rise when soldered because all surfaces of the terminals are plated. Accordingly, when the solder and the flux enter the gap between the housing and the terminals and reach the contact portions of the terminals, the contact between the terminals and the terminals of the mating connector may become poor, thereby reducing reliability of the contact. In a small and short electrical connector, a distance between the connection portions and the contact portions is short. Accordingly, the solder and the flux may easily reach the contact portions of the terminals. Consequently, the gap between the housing and the terminals may be enlarged, thereby reducing a retention force of the housing to hold the terminals.

Further, in the electrical connector disclosed in Patent Reference, the terminals are plated after being bent to form. Accordingly, in case the terminals collide with each other or surroundings, the terminals are likely to be pressured and deformed. Further, when the housing is integrally formed with the terminals, a material of the housing or residue and dust generated by plating may adhere to the terminals. Consequently, the contact of the terminals may become poor.

In view of the problems described above, an object of the present invention is to provide an electrical connector and a method of producing the same. The electrical connector has terminals integrally formed with and held by a housing. Further, in the electrical connector, the flux is less likely to rise when soldered.

SUMMARY OF THE INVENTION

In order to achieve the above objects, in the present invention, when an electrical connector is produced, terminal portions having a carrier are integrally formed with a housing. The housing holds the terminal portions. Further, the terminal portions are separated from the carrier, so that the terminal portions become independent terminals.

In the electrical connector, each of the terminals is provided with a first surface and a second surface. The first surface does not contact with the housing and is plated, while the second surface contacts with the housing and is not plated.

In the electrical connector, the contact portion and the connection portion are provided on the first surface that is exposed and plated. Accordingly, when the electrical connector is used, the contact portions and the connection portions have good electrical contact characteristic and adhesive characteristic to solder. Further, a gap formed between the housing and the contact surfaces is reduced since the second surface adjacent to the housing is not plated. Accordingly, when soldered, rising of the flux to the gap is likely to be prevented.

In the method of producing the electrical connector in the present invention, at least the terminal portions are plated after the terminal portions and the housing are integrally formed. Then, the electrical connector may be produced by separating the terminal portions from the carrier.

In the present invention, the plating includes plating to make an electrical contact and soldering easier. For example, the plating may include gold plating or silver plating. The plating does not include base plating or corrosion proof plating such as nickel plating. Accordingly, in the present invention, base plating or corrosion proof plating may be provided on the contact surfaces of the terminals with respect to the housing.

As described above, in the electrical connector, the terminal is provided with the first surface and the second surface. The first surface does not contact with the housing and is plated, while the second surface contacts with the housing and is not plated. Accordingly, the contact portions and the connection portions provided on the first surfaces have good electrical contact characteristic and adhesive characteristic to solder. The second surfaces that contact with the housing are not plated. Accordingly, the solder and the flux are not likely to enter the gap formed on the contact surfaces between the terminals and the housing.

Further, in the method of producing the electrical connector in the present invention, the electrical connector may be obtained by separating the carrier after the terminal portions and the housing are integrally formed and the carrier and the terminals are plated. Specifically, in the terminal structure that arranges a pair of the terminals in rows in parallel, all terminals may be plated at once after the terminal portions and the housing are integrally formed. Accordingly, the electrical connector may be produced easier than when the terminal portions and the housing are integrally formed after plating the terminal rows that are facing each other.

In the present invention, the terminals are plated after the terminal portions and the housing are integrally formed. Accordingly, the terminals are not likely to be deformed when plated. Further, a material of the housing or residue and dust yielded by plating may be cleaned and removed during a production process. Accordingly, a poor contact of the terminals due to an adherence of dust may be prevented.

DESCRIPTION OF THE PREFERRED EMBODIMENTS

Figure 1:
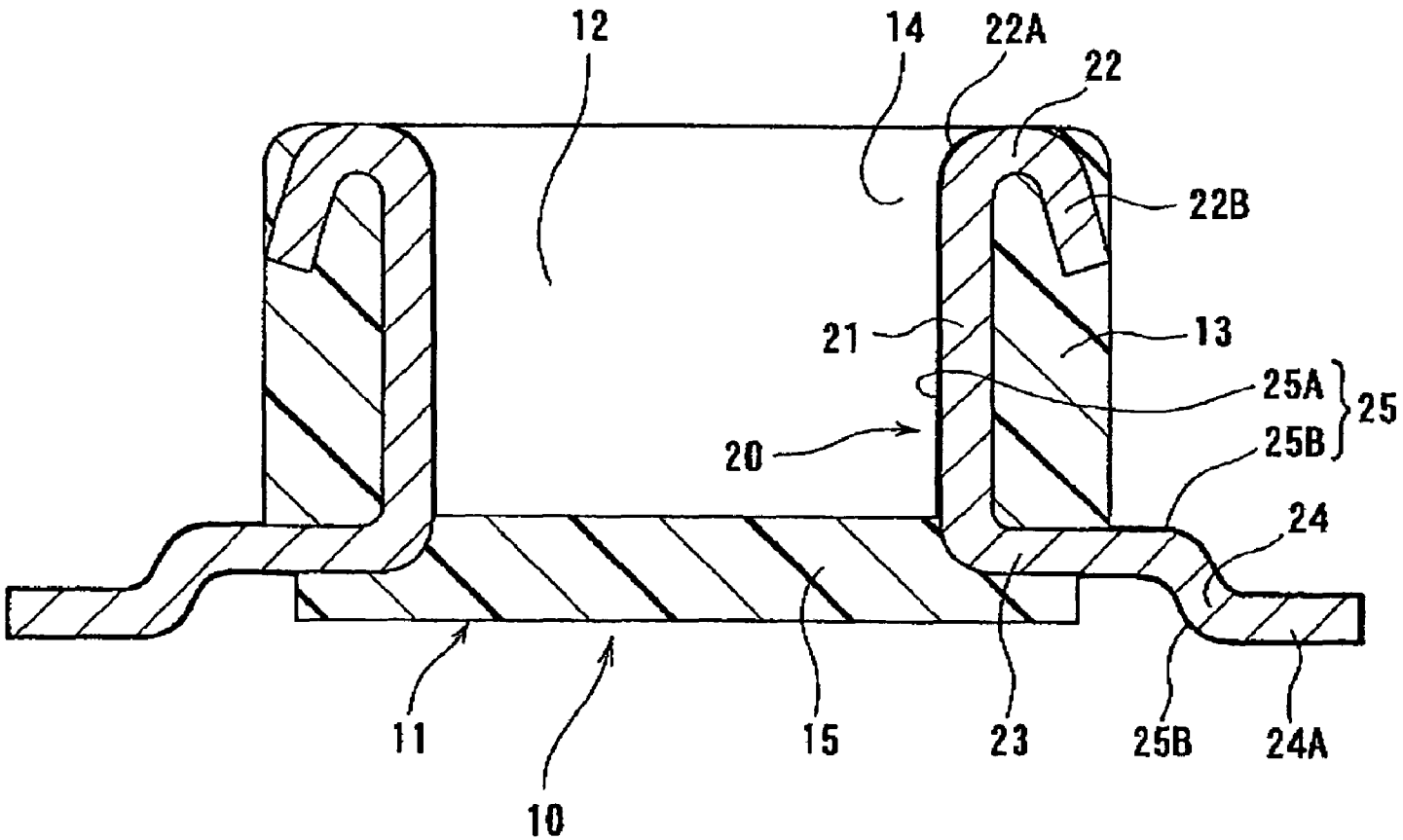
FIG. 1 is a vertical sectional view showing an electrical connector of the present invention.
Figure 2:
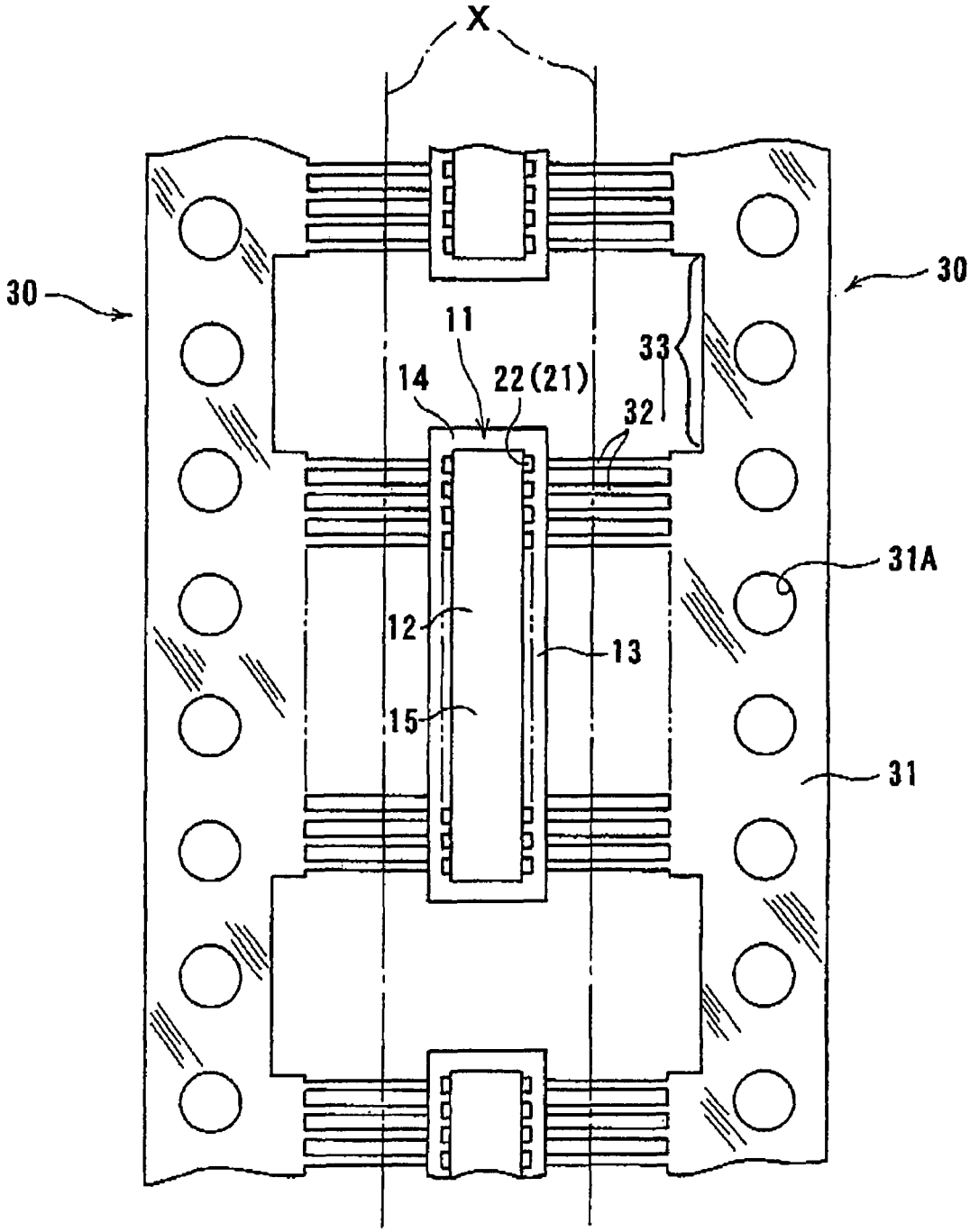
FIG. 2 is a plan view showing a production process of the electrical connector.

Hereunder, embodiments of the present invention will be explained with reference to the accompanying drawings. FIG. 1 is a vertical sectional view showing an electrical connector 10 of an embodiment in the present invention. FIG. 2 is a plan view showing a production process of the electrical connector 10 of FIG. 1.

As shown in FIG. 1, the electrical connector 10 is in a box shape having a bottom and includes a housing 11 formed by molding an insulating resin. The housing 11 is provided with a depressed portion 12 to receive a mating connector (not shown) therein. The electrical connector 10 extends in a direction perpendicular to a sheet surface of FIG. 1, and has a long rectangular shape in a plan view as shown in FIG. 2. Further, the housing 11 is provided with a pair of sidewalls 13, edge walls 14, and a bottom wall 15. The sidewalls 13 are in a long rectangular planar shape and extend in a longitudinal direction. The edge walls 14 connect end portions of the sidewalls 13. The bottom wall 15 connects lower edges of the sidewalls 13 and lower edges of the edge walls 14.

In the embodiment, each of the sidewalls 13 of the housing 11 is provided with a plurality of terminals 20 at a specific interval in a longitudinal direction thereof. A plurality of terminals 20 and the housing 11 are integrally formed, and the housing 11 holds a plurality of terminals 20. As shown in FIG. 1, a pair of the sidewalls 13 facing each other holds a plurality of terminals 20. Each of the terminals 20 has a symmetrical shape and is arranged symmetrically.

In the embodiment, a thin flat metal band is punched out and bent toward a plate thickness direction thereof to form the terminal 20. As shown in FIG. 1, the terminal 20 comprises a contact portion 21, an introduction portion 22, a retained portion 23, and a connection portion 24. The contact portion 21 is closely attached to an inner surface of the sidewall 13 of the housing 11 and upright. The introduction portion 22 is bent in an inverted U-shape toward an edge portion of the electrical connector 10 to form a curve portion above the contact portion 21. The retained portion 23 is bent in an L-shape below the contact portion 21 and held by the housing 11. The connection portion 24 extends from the retained portion 23 and protrudes to an outside of the housing 11.

In the embodiment, exposed plate surfaces of the contact portions 21 of the terminals 20 are flush with or slightly protrude from inner surfaces of the sidewalls 13 of the housing 11. That is, the contact portions 21 are buried at least partially in the sidewalls 13 in a plate surface direction.

In the embodiment, the introduction portion 22 includes an inner curved surface 22A. The inner curved surfaces 22A adhere to inner surfaces of an upper edge of the sidewalls 13 and are buried inside of the side walls 13. The inner curved surfaces 22A may easily guide and introduce terminals of the mating connector. Edge portions 22B are securely held by the sidewalls 13 of the housing 11. The retained portions 23 are completely buried in the housing 11 and held firmly by the housing 11.

In the embodiment, the connection portions 24 extend outside of the housing 11 and are bent in a crank shape outside of the housing 11. Distal portions 24A of the connection portions 24 are substantially flush with or situated slightly downward of a bottom face of the housing 11. When the electrical connector 10 is mounted to a circuit board (not shown), the distal portions 24A of the connection portions 24 contact with corresponding circuit portions of the circuit board and are connected to the circuit portion with solder.

In the embodiment, the electrical connector 10 is provided with plated layers 25 on exposed surfaces of the terminals 20. The plated layer 25 comprises a plated layer 25A provided on an exposed surface of the contact portion 21 and a part of the introduction portion 22 and a plated layer 25B provided on a surface of the connection portion 24. The terminals 20 electrically contact well with the terminals of the mating connector through the contact portions 21 and the plated layers 25A of the introduction portions 22. The plated layers 25B of the connection portions 24 make a soldering well. The surfaces of the terminals 20 adjacent to the housing 11 are not plated.

Next, a method of producing the electrical connector 10 will be explained with reference to FIG. 2. As shown in FIG. 2, terminal members 30 are integrated with the housing 11. The terminal member 30 includes a carrier portion 31 and a terminal portion 32. The terminal member 30 is made as a long metal plate formed by punching out and is rolled. The terminal member 30 is pulled out from a roll when used.

As shown in FIG. 2, two terminal members 30 are symmetrically situated. Each of the terminal members 30 is provided with a carrier portion 31 in a flat band shape extending in a longitudinal direction with respect to the terminal members 30. The carrier portion 31 is provided with a plurality of engagement holes 31A at a specific interval in a longitudinal direction thereof. The engagement holes 31A engage with transport nails of a transport device. Further, the terminal members 30 are transported to the longitudinal direction thereof intermittently during positioning and a production process. Terminal portions 32 are provided in a perpendicular direction with respect to the longitudinal direction from inner edge portions of the carrier portions 31 at an interval of distances 33. The terminal portions 32 are formed per a group of the number to be held by each of the sidewalls 13 of the connector.

In the embodiment, the terminal portions 32 stretch from the carrier portions 31. As shown in FIG. 1, the terminal portion 32 comprises the connection portion 24, the retained portion 23 formed flexibly, the contact portion 21 standing upright, and the introduction portion 22 in an inverted U character shape. As shown in FIG. 2, the terminal portions 32 extending from the terminal members 30 are integrally formed with the housing 11 along the longitudinal direction thereof. Further, as shown in FIG. 1, the retained portions 23 of the terminal portions 32, the contact portions 21, and the introduction portions 22 are integrally formed with the housing 11.

Accordingly, a plurality of the housings 10 is integrally formed with the terminal members 30. Further, a plurality of the housings is immersed in a plating bath (not shown) and plated in a state that the terminal portions 32 are held. Both the carriers 31 and the terminal portions 32 may be plated, or only the terminal portions 32 may be plated. When plated, the plated layers are formed only in the portions of the terminal portions 32 that are exposed from the housing 11, but not in the portions that are adjacent to the housing 11. Further, specific positions of the terminal portions 32 are cut to separate the carrier portions 31 to obtain the connector 10 shown in FIG. 1. Accordingly, in the electrical connector 10, the plated layers 25 are formed only in the surfaces of the terminals 20 exposed from the housing 11. The plated layer 25 includes the plated layer 25A of the contact portion 21 and the introduction portion 22 and the plated layer 25B of the connection portion 24.

In the embodiment, when the electrical connector 10 is mounted to the circuit board, a solder may be applied to the plated layers 25B of the connection portions 24 with ease. Further, when the electrical connector 10 is fitted to the mating connector, the plated layers 25A of the contact portions 21 improve an electrical contact with the mating connector. Even though there is a gap between the housing 11 and the terminals 20, the terminals 20 that are situated in the gap are not plated. Accordingly, when a solder is applied to the connection portions 24, the solder or a flux are not likely to enter the gap.

The present invention is not limited to the present embodiment, and may be modified. A shape and a position of the terminal 20 may be changed. The terminal 20 only needs to be integrally formed with and held by the housing 10 and has both an exposed portion and a non-exposed portion. A configuration of the electrical connector 10 is not limited and may be different.

Further, there are many ways to plate. The area except for an area adjacent to the housing 10 of the terminals 20 may be plated before the terminals 20 and the housing 10 are integrally formed.

What is claimed is:

1. An electrical connector produced by the steps of:

bending a flat portion of a terminal member in a thickness direction thereof, said terminal member being formed of a metal plate and including a carrier portion and the flat portion connected to the carrier portion to form a terminal portion including a contact portion at one end portion thereof for contacting with a mating terminal of a mating connector, a connection portion at the other end portion thereof for connecting to a circuit board, and a retaining portion at a middle portion thereof to be retained in the housing;

molding the housing integrally with the terminal portion so that one surface of the contact portion is exposed from the housing and the other surface of the contact portion contacts with the housing, said connection portion protruding from the housing and having a whole surface exposed from the housing, said retaining portion contacting with the housing to be directly retained in the housing;

plating the terminal portion after the housing is integrally molded with the terminal portion in a state that the terminal portion is connected to the carrier portion; and cutting the terminal portion from the carrier portion to obtain the electrical connector.

2. The electrical connector according to claim 1, wherein said terminal portion further includes an introduction portion with a curved portion.

3. The electrical connector according to claim 1, wherein said housing further includes a depressed portion for receiving a mating connector, said connection portion of the terminal portion extending outside the depressed portion.

4. The electrical connector according to claim 1, wherein said housing further includes a depressed portion for receiving a mating connector, said contact portion of the terminal portion being disposed inside the depressed portion.

5. A method of producing an electrical connector, comprising the steps of:

bending a thin flat metal band of a terminal member formed of a metal plate, having a carrier portion and the thin flat metal band connected to the carrier portion in a plate thickness direction thereof to form a terminal portion having a contact portion at one end portion thereof for contacting with a mating terminal of a mating connector, a connection portion at the other end portion thereof for connecting to a circuit board, and a retaining portion at a middle portion thereof to be retained with a housing;

integrating the terminal portion with the housing so that one surface of the contact portion is exposed from the housing, the other surface of the contact portion contacts with the housing, the connection portion protrudes from the housing, a whole surface of the connection portion is exposed from the housing, and the retaining portion contacts with the housing and is directly retained with the housing;

plating the terminal portion after the terminal portion is integrated with the housing in a state that the terminal portion is connected to the carrier portion; and cutting the terminal portion from the carrier portion.

* * * * *